US005669214A

United States Patent [19]

Kopanakis

[11] Patent Number: 5,669,214

[45] Date of Patent: Sep. 23, 1997

[54] STRANDED WIRE ROPE OR CABLE HAVING MULTIPLE STRANDED ROPE ELEMENTS, STRAND SEPARATION INSERT THEREFOR AND METHOD OF MANUFACTURE OF THE WIRE ROPE OR CABLE

[75] Inventor: Georg A. Kopanakis, Waldshut-Tiengen, Germany

[73] Assignee: Fatzer AG, Romanshorn, Switzerland

[21] Appl. No.: 538,408

[22] Filed: Oct. 2, 1995

Related U.S. Application Data

[63] Continuation-in-part of Ser. No. 455,332, May 31, 1995, abandoned.

[30] Foreign Application Priority Data

Oct. 11, 1994 [CH] Switzerland ..... 03 048/94

[51] Int. Cl.[6] ..... D07B 1/06; D02G 3/06

[52] U.S. Cl. ..... 57/218; 57/31; 57/220; 57/222; 57/225; 57/231; 57/235; 57/260

[58] Field of Search ..... 57/210, 212, 222, 57/223, 31, 235, 260, 218, 220, 225, 231

[56] References Cited

U.S. PATENT DOCUMENTS

| | | | |
|---|---|---|---|
| 2,136,865 | 11/1938 | Reed . | |
| 2,136,866 | 11/1938 | Reed | 57/220 |
| 2,136,867 | 11/1938 | Reed | 57/220 |
| 3,106,815 | 10/1963 | Nance et al. | 57/210 |
| 4,166,355 | 9/1979 | Gross | 57/212 |
| 4,509,319 | 4/1985 | Yoshida et al. | 57/218 |
| 5,386,683 | 2/1995 | Misrachi | 57/222 |

FOREIGN PATENT DOCUMENTS

| | | | |
|---|---|---|---|
| 31 49 783 A1 | 7/1982 | Germany . | |
| 90 10 258 | 10/1990 | Germany . | |
| 27 736 | 5/1911 | United Kingdom . | |
| 2126613 | 3/1984 | United Kingdom | 57/212 |

*Primary Examiner*—William Stryjewski
*Attorney, Agent, or Firm*—Frishauf, Holtz, Goodman, Langer & Chick, P.C.

[57] ABSTRACT

To reduce elongation of a stranded wire rope or cable (1), particularly when running over sheaves, or pulleys, and decrease vibration as well as operating noise while increasing operating speed, insert elements (4) are placed between adjacent rope elements (2). The insert elements, in cross-section, have an intermediate portion part (7) with oppositely positioned concave recesses (9), a head portion (6) which can be widened to the circumferential diameter of the rope or cable (1) and a widened base portion (8). The base portions (8) are not interconnected. The insert ribbons or tapes are preferably formed along their length with slits (11) extending from the head portion (6) to about the middle of the ribbon or tape to allow for bending of the rope, and the inserts about circular pulleys. The insert elements (64, 74, 94), preferably, are reinforced with a fabric material (16, 96), which is integrated into the material of the inserts, and located, for example adjacent the concave recesses, or in a central plane of symmetry, or with longitudinal reinforcements (84), such as reinforcement fibers, glass fibers, monofilaments or the like. Preferably, the fabric is a woven fabric of fibrous or monofilamentary material, yarns or threads.

21 Claims, 3 Drawing Sheets

STRANDED WIRE ROPE OR CABLE HAVING MULTIPLE STRANDED ROPE ELEMENTS, STRAND SEPARATION INSERT THEREFOR AND METHOD OF MANUFACTURE OF THE WIRE ROPE OR CABLE

This application is a continuation-in-part of U.S. Ser. No. 08/455,332, filed May 31, 1995, abandoned Jun. 8, 1996.

FIELD OF THE INVENTION

The present invention relates to a stranded wire rope or cable, especially a cable made of steel strands which strands, in turn, are formed by steel strand wire elements, and to a strand separation insert. Preferably, the cable has at least four spirally distributed stranded elements, stranded together.

BACKGROUND

It is customary to make wire ropes or cables by twisting already stranded wire rope elements in a stranding machine about a core. Usually, the core is round. This spiral twisting causes deformation of the initially round core due to the radial pressure being exerted by the rope or cable elements. The wire rope or cable thereby receives the final shape or form.

Difficulties arose in use of such wire ropes or cables due to elongations which may be permanent. Measures must be taken to compensate for elongation and maintain desired, or necessary tension on the wire rope. When the wire ropes are passed about sheaves, pulleys, or the like, vibrations can be transferred from the rope, or the sheaves or pulleys to structural or machine parts. The vibrations are a consequence of the helical surface of the wire rope running off support rollers or sheaves. Such vibrations in many instances limit the possible speed of operation of the rope, and hence the transport capacity of carriers or the like connected thereto.

THE INVENTION

It is an object to provide a stranded wire rope or wire cable, and typically a stranded steel wire rope having multiple strand stranded rope elements which, in comparison to conventional wire ropes or cables has a substantially decreased remanent elongation when in operation, and which is less, or hardly at all subject to vibration when running over rollers or pulleys, while having an increased life-time; to a method of its manufacture; and to a separating insert suitable for separating stranded rope elements of the stranded wire rope, or cable.

Briefly, adjacent stranded rope elements of the wire, rope or cable are separated from each other by inserts in forms of tapes or ribbons, placed on edge, which have a head portion at the outer circumference of the wire rope and a base portion at the inside. The head and base portions are enlarged, or thickened with respect to an intermediate portion of the insert tape or strip or ribbon. The intermediate portion is formed with oppositely located concave depressions, and constricting the cross-section of the tape or ribbon. These concave portions engage against the normally round stranded rope elements. The head portions terminate at the theoretical outer diameter circle of the rope or cable. The base portions are separated from each other, that is, not mutually interconnected.

The arrangement provides for precisely defined location of the rope elements, and thus precise maintenance of the stranding or twist length, or spiral pitch of the wire or cable. The inserts, in tape or ribbon form prevent migration of the rope elements towards the center. Thus, the spacing of the rope elements from the center, and the pitch of the twisted or stranded rope element is fixed, or predetermined. As a consequence, the remanent elongation of the overall steel wire rope or cable will be substantially less than steel wire ropes or cables of the prior art.

The insert elements between the respective rope elements separate adjacent rope elements from each other. The unavoidable shifts to compensate for different diameters when the rope is passed over a curved surface, for example a pulley, thus can be accepted much easier than heretofore. Consequently, the individual stranded wires, as well as the stranded rope elements are substantially less stressed than heretofore, resulting in an increased life-time of the rope or cable as a whole.

The inserts, which extends up to the theoretical outer circumference of the rope elements have another advantage in that they effect increase, up to doubling of the contract and support points when the overall rope or cable runs over support or guide rollers. As a result, the run will be substantially more quiet and less vibrating than heretofore, and tendency to oscillations or vibrations is substantially reduced or even entirely eliminated. Elimination of such spurious movement permits increase of operating speed of the rope or cable with respect to a fixed point, for example the axis of rotation of a roller or pulley.

An insert which is particularly wear and tear resistant and has long life in spite of the high stresses placed on the insert element in operation has an integrated fabric placed as an inlay, or reinforcement in at least a concave middle portion of the insert.

It is desirable that wire ropes or cables have as small a diameter as possible, consistent with the required strength, or carrying capability of the cable. To reduce the diameter of such cables, it is necessary to reduce the thickness of the center or intermediate portions of the insert elements. The intermediate portion, it has been found, is particularly stressed since several force components act thereon. The direction of these force components changes during use of the cable, for example when it runs over a support roller, or a roller pulley or sheave. Forces which act on these inserts are pressure forces, torsion forces as well as bending forces. Reinforcing the center portion, at least, of the inserts by a fabric, integrated into the inserts, which, typically are made of plastic material, permits substantially improved acceptance of the stresses, and the wear and tear, as well as the acceptance of the forces to which the insert elements are subjected. This improves the lifetime of the overall cable.

The reinforcement material preferably is a textile, and especially a woven textile material; this is in contrast to insert formed of separate fibers or short strands. A fabric inlay, integrated into the insert element forms an unremovably bonded reinforcement. When subjected to torsion, the support effect obtained by a fabric insert is an improved, a real reinforcement. The individual spirally twisted cable elements do not engage the center or median portion of the insert with a portion of their circumference.

DRAWINGS

DETAILED DESCRIPTION

Figure 1:
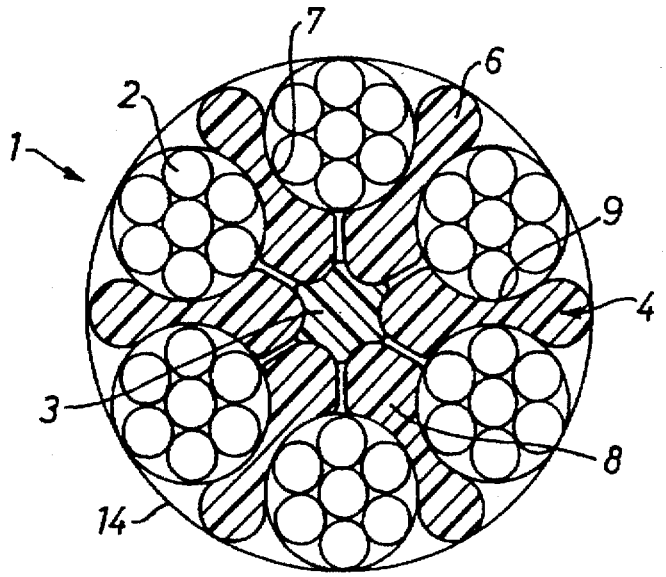
FIG. 1 is a highly schematic cross-sectional view through a stranded steel wire rope or cable having multiple stranded rope elements.

The stranded steel wire rope or cable 1 is particularly suitable as a support cable, or as a pull cable, for example for use in cableways, cable cars or the like. The wire rope 1 is a composite formed of a plurality, preferably at least four, in the example six, or eight wire elements 2. More than eight may be used for special applications. Each one of the wire elements 2 has seven individual wires which, in turn, can again be stranded wire structures. A larger or lesser number than such individual wires, or composite form of strands, can be stranded together to form one of the rope elements 2.

A core 3 of elastic or elastomer material is located in the center of the wire rope 1. It extends in longitudinal direction of the wire rope. Insert elements 4, spiralled according to the shape of the rope elements 2 are uniformly located in a circle about the core.

In accordance with the present invention, the insert elements 4 are of ribbon or tape form which have, at the outer side, a head portion 6, a central portion 7 and a base portion 8. The head portion 6 and the base portion 8 are thickened, in cross-section, with respect to the central portion 7. The central, or intermediate portions 7, looked at in cross-section, is formed of two oppositely placed concave recesses 9. The radius of the recesses 9 corresponds at least approximately to the circumferential radius of the adjacent rope element 2, see FIG. 1. The insert elements 4 are not connected to the core 3 or to each other.

Two adjacent rope elements 2, thus, engage against the internally bulged, or recessed central portions 7 of the separating tape or ribbon 4, and are spaced by the tape or ribbon 4 from each other. The head portions 6, as best seen in FIG. 1, are rounded at the outside and end at a theoretical surrounding circle 14 of the rope 1 having its center shown at 12. Consequently, the engagement points for support, guidance, or carrying rollers or pulleys is doubled which results in extremely quiet running operation of the rope.

The base portions 8 are rounded where they face the core and each other. They are not connected among each other, and are widened with respect to the intermediate portion 7. Due to radial pressure when the rope is stranded, the originally round core 3 is deformed at the engagement regions of the rounded base portions 8 of the inserts. This deformation, along the rope, is in spiral form. Six inserts 4 are located, in star-shaped arrangement, with the base portions 8 fitting against each other, but not connected. The base portions 8 are wedge-shaped and, in cross section, essentially triangular with 60° angles at the inner apex. Lateral surfaces of the wedge-shaped base portions fit against each other and, in use, are engageable with each other, see especially FIGS. 4 and 5.

The inserts 4, preferably, are made of a drawn, or pultruded, i.e. a combination of pulling or drawing, and extrusion, or of extruded plastic wire or ribbon structure having the profile, or shape as described. Suitable materials are glass fiber reinforced epoxy-vinyl ester resin, or polyethylene. Other materials may also be used for the inserts 4.

Figure 2:
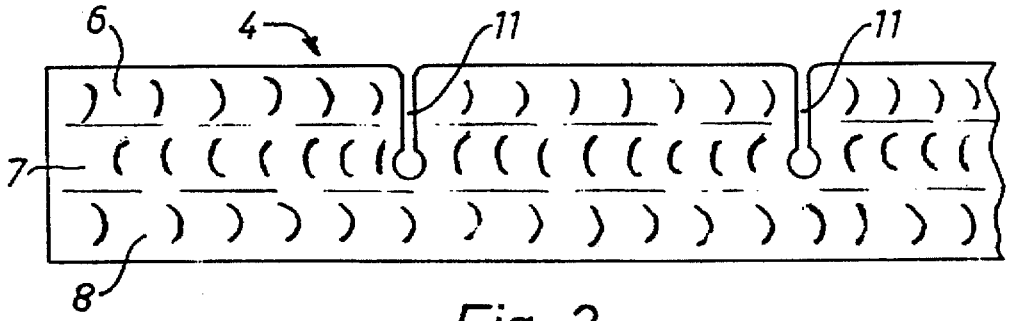
FIG. 2 is a schematic side view of a portion of a insert ribbon or tape.
Figure 3:
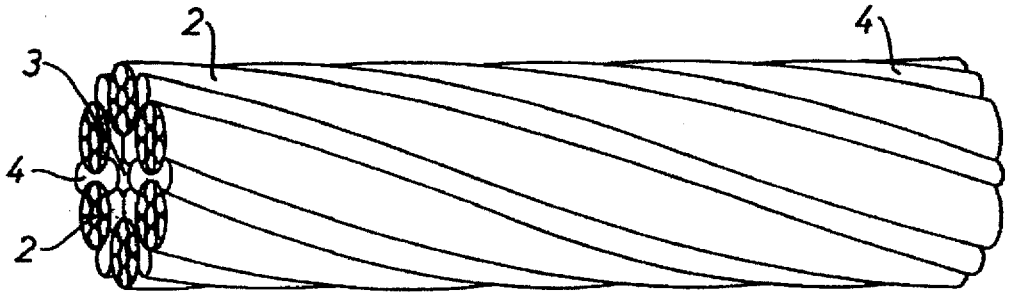
FIG. 3 is a side view of the stranded steel wire rope or cable, and illustrating an end cut.

As best seen in FIG. 2, the inserts 4 are preferably formed with regularly recurring cuts 11 which extend from the head portion 6 up to about the center of the intermediate portion 7. The purpose of the cuts is to reduce tensions which result due to the difference in length between the head portion and the base portion when the cable runs over a curved surface, for example a pulley or sheave.

Figure 4:
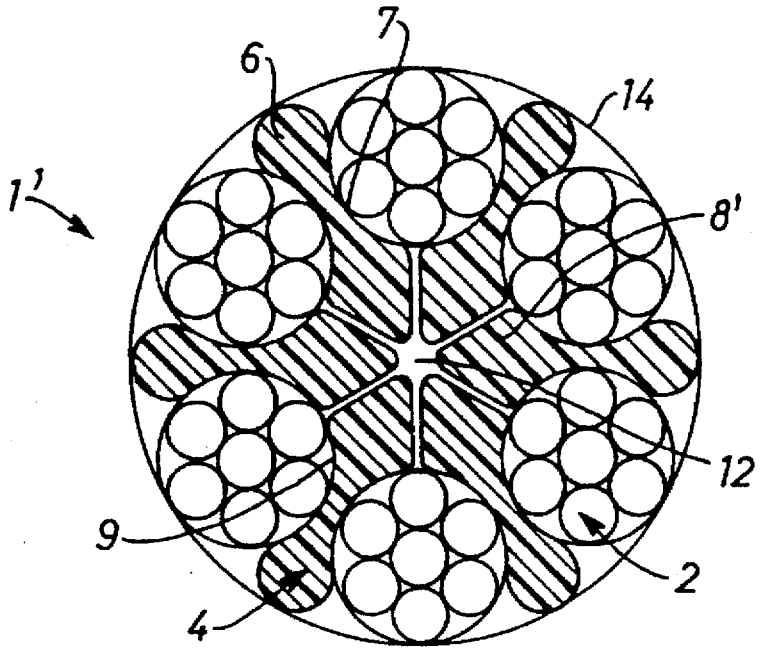
FIG. 4 is a cross section, (similar to FIG. 1) and illustrating a second embodiment of the invention, without a central core.

The embodiment of FIG. 4 is similar to that described, except that the wire or rope or cable 11 does not have a central core. The base portions 8' are extended close to the center 12 of the cable; the base portions 8' again, are not interconnected.

Figure 5:
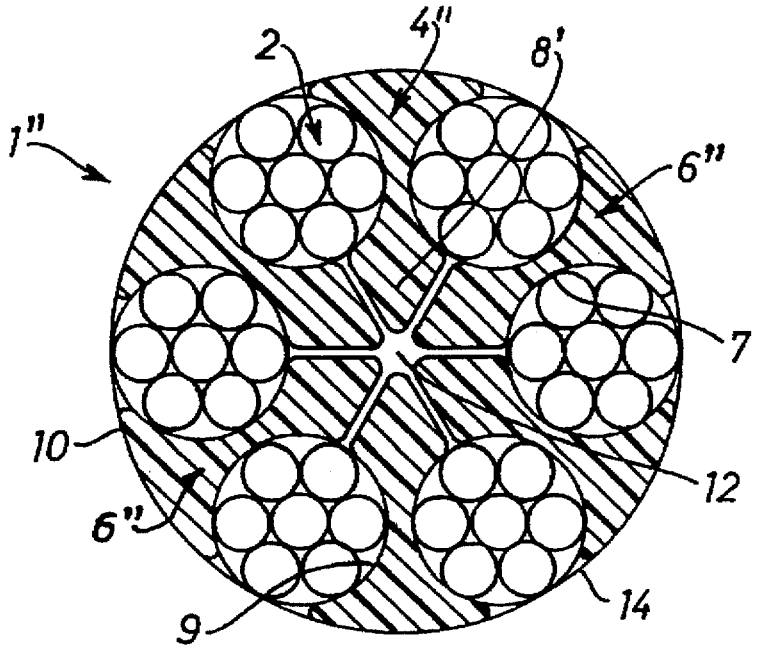
FIG. 5 is a cross section illustrating a third embodiment of a stranded steel wire rope or cable without a central core, and having enlarged head portions on the inserts.

The embodiment of FIG. 5 illustrates inserts in which the head portion 6" is widened to the extent that a bulge 10 results which is located in a space formed by the peripheries of two adjacent wire elements 2 and the theoretical circular circumference of the wire or rope 1". This space is filled essentially entirely by the head portion 6" of the insert 4". Such a cable will have essentially area or surface contact with rollers or pulleys rather than line contact as has the cable of FIG. 1.

Splicing of such cables is simplified when the core 3 of FIG. 1 or the space which it occupies is selected to have a dimension which at least roughly corresponds to the diameter of a rope unit 2. This permits removal of the core in the region of the splice without essentially changing the diameter of the cable as a whole.

The stranded steel wire rope of any one of the embodiments can be readily made on a customary and standard rope making, or a stranding machine. The insert 4, in accordance with the present invention, can be inserted during stranding similar to additional wires or serving strands, or similar to the rope elements 2, and can be stranded together with the rope elements 2 as they are beings supplied.

If the wire or cable does not have a core, the base portions 8' can be formed in wedge shape (FIGS. 4 and 5), the apex of which extends up to close the core-less center line 12 of the wire or cable.

Figure 6:
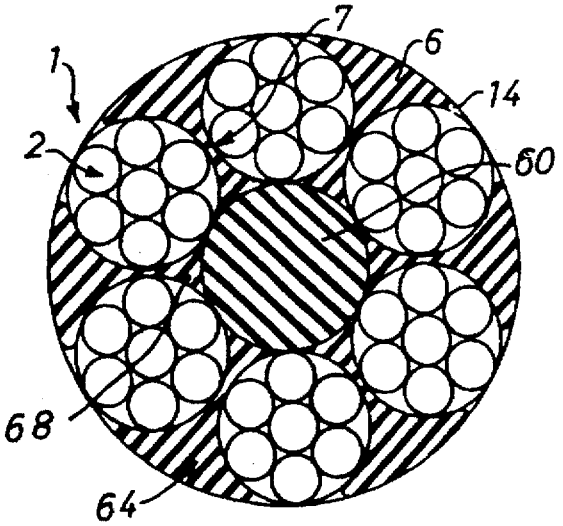
FIG. 6 is a cross section, similar to FIG. 1, illustrating yet another embodiment of the invention, with a solid central core of essentially circular cross section.

FIG. 6 illustrates a wire and cable with a central core 60. The diameter of the central core is selected to be so dimensioned that it engages, or touches the wire strands 2, or at least approaches very close to the wire strands 2, with little clearance, which can be taken up, for example, if the cable runs over a pulley. In elongated, straight condition of the cable, however, there may be a slight clearance between the circumference of the central core 60 and the inner circumference of the individual strands 2. The foot or base portion 68 of the insert 64 are formed with a concave inwardly-curved surface 61 (FIG. 9) which engages against the core 60. The core 60 is made of a elastomer material, which can be of the same material or a similar material as the insert 64, or a material, at least of the same type.

Figure 7:
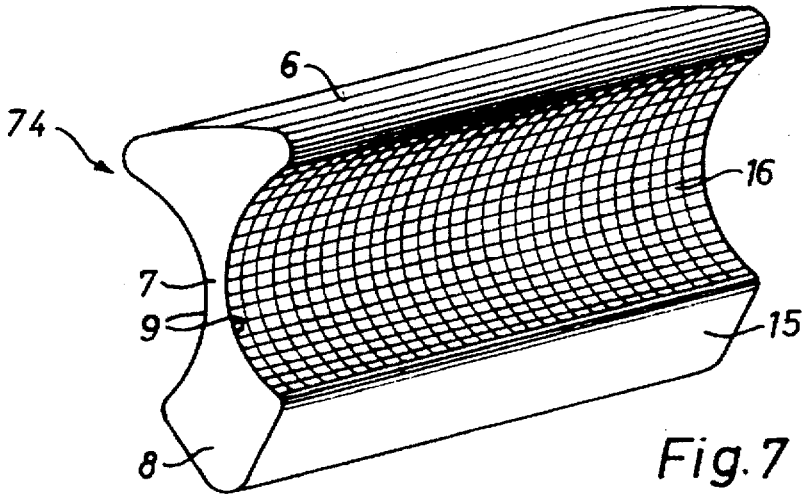
FIG. 7 is an isometric view of a single insert element, in tape or ribbon form, and schematically illustrating the reinforcement fabric, embedded into the insert—which can be translucent.
Figure 8:
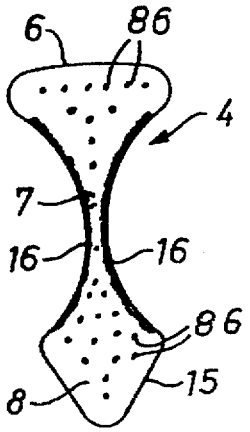
FIG. 8 is a cross-sectional view through one form of insert with a double-sided fabric reinforcement.

In accordance with a feature of the invention, and in order to improve the strength of the insert 64, 74 the central, inwardly curved concave portions 7 are reinforced at both sides with a fabric 16 (FIGS. 7, 8). The fabric 16 is close to the surface and irremovably bonded to the material of the insert 64, 74 that is, it is integrated into the material. The fabric, preferably, is made of threads or yarns of man-made fibers, glass fibers, or natural fibers or a fabric made of or including mono-filamentary materials. The fabric, preferably, is woven.

The inserts 64, 74 preferably are made in the form of an extruded plastic tape or ribbon profile. A particularly suitable material is glass fiber reinforced epoxy-vinylex resin, or polyethylene. Insert 74 is shown similar to insert 4, FIG. 5.

Figure 9:
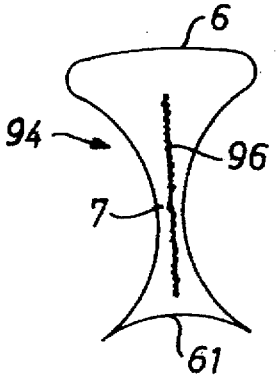
FIG. 9 is a schematic cross-sectional view through an insert with a single centrally-embedded reinforcement.

FIG. 9 illustrates another embodiment in which a fabric reinforcement 96 is located at least essentially in the symmetrical vertical cross-sectional plane of the insert 94. The fabric insert 96 is shorter than the entire height of the insert element 94.

It is also possible to reinforce the head portion 6 as well as the bottom or foot portion 8 by wrapping the fabric 16 over the entire insert element, and bonding the fabric thereto, for example just beneath the surface thereof.

Additional reinforcements may be formed in the inserts, for example by introducing a plurality of longitudinal monofilaments or fibrous filaments 86, as schematically indicated in FIG. 8, as desired, in the central portion 6, and/or in the bottom or foot portion 8, and/or in the head portion 6.

The manufacture of the insert element 64, 74, 94 is similar to the manufacture of the insert elements 4, previously described. The reinforcement fabric 16, and the insert strands 86, if used, are extruded together with the elastomer material, so that the result will be a reinforced unitary structure, in which the reinforcement material is irremovable from the body of the insert as such.

The inserts 4, 64, 74, 94 are spiralled together with the wire element 2 when the cable is finished.

Various changes and modifications may be made and any features described herein may be used with any of the others, within the scope of the inventive concept.

I claim:

1. A stranded wire rope or cable having six stranded wire rope elements (2) helically stranded about a center line (12) extending longitudinally within the rope or cable;

insert elements (4) located between the stranded rope elements (2), wherein the insert elements comprise ribbons or tapes (4), each having two end portions defining, each, a head portion (6) and a base portion (8), and an intermediate portion (7) between said head portions and base portions, wherein the base portions are essentially wedge-shaped defining lateral surfaces and an apex, said apex facing said center line (12), each with an angle of 60° at said apex, and extend close to the center line (12) of the rope or cable with said lateral surfaces of adjacent wedge-shaped portions engageable with each other, wherein said base portions (8) of the respective insert ribbons or tapes are separate from each other;

wherein the intermediate portions (7), in cross section, are formed with two opposite concave depressions (9), said depressions engaging against adjacent rope elements (2); and wherein the head portions (6) terminate at a theoretical outer surrounding circle (14) of the rope or cable (1).

2. The rope or cable of claim 1, wherein the head portions (6") of the insert elements (4") are formed with an outer bulge or thickening (10) which at least approximately fills the space between peripheries of two adjacent rope elements (2) and the theoretical outer circle (14) of the rope or cable (1).

3. The rope or cable of claim 1, wherein the ribbons or tapes (4) are formed with spaced radial slits (11) extending from the head portion (6) and up to part of the intermediate portions (7).

4. The rope or cable of claim 1, wherein the insert ribbons or tapes (4) are formed of extruded, or of drawn plastic material, optionally of epoxy-vinyl ester resin, or of polyethylene, said inserts being fiber reinforced at least at said intermediate portion (7).

5. A method to make a stranded wire rope or cable (1) as claimed in claim 1, comprising the steps of stranding together said six wire rope elements (2) and, in one stranding operation and while stranding, positioning said insert ribbons or tapes (4) between adjacent rope elements (2), by alternately stranding wire rope elements (2) and insert ribbons or tapes (4); and providing said insert ribbon or tapes, before stranding, with a shape which includes, for each ribbon or tape, the enlarged head portion (6), the wedge-shaped base portion (8), and the intermediate portion (7) between the head and base portions, in which the intermediate portion (7), in cross section, is formed with two concave recesses (9); and wherein said stranding step comprises placing said recesses (9) against adjacent rope elements (2) and fitting the wire rope elements in the concave recesses during said one stranding operation.

6. A stranded wire rope or cable having six stranded wire rope elements (2) helically stranded about a center line (12) extending longitudinally the rope or cable; and insert elements (4) located between the stranded rope elements (2), wherein the insert elements comprise ribbons or tapes (4), each having two end portions defining a head portion (6) and a base portion (8), respectively, wherein the base portions (8) are essentially wedge-shaped with a wedge angle of 60°, said ribbons or tapes further having an intermediate portion (7) between said head and base portions, a central core (3) located essentially along the center line (12) of the rope or cable (1);

wherein the central core (3) comprises elastomer material;

wherein the base portions (8) of the respective insert ribbons or tapes are separate from each other and from the core;

wherein the base portions (8) of the ribbons or tapes (4) and the central core (3) are closely spaced or in engagement, wherein the base portions (8) are rounded at regions of engagement with the core (3) and at sides facing an oppositely positioned base portion;

wherein the intermediate portion (7) in cross section, is formed with two opposite concave depressions (9), said depressions engaging against adjacent rope elements (2), the concave depressions (9) of the intermediate portion (7) being essentially part circular and formed with a radius which at least approximately corresponds to the radius of the rope elements (2); and wherein the head portions (6) terminate at a theoretical outer surrounding circle (14) of the rope or cable (1).

7. The rope or cable of claim 6, wherein the ribbons or tapes (4) are formed with spaced radial slits (11) extending from the head portion (6) and up to part of the intermediate portion (7).

8. The rope or cable of claim 6, wherein the base portions define lateral surfaces and rounded apeces facing said core, with the lateral surfaces of adjacent base portions being engageable with each other; and the insert ribbons or tapes (4) are formed of extruded, or of drawn plastic material, optionally of epoxy-vinyl ester resin, or of polyethylene, said inserts, optionally, being fiber reinforced.

9. A stranded wire rope or cable having six stranded wire rope elements (2) helically stranded about a center line (12) extending longitudinally within the rope or cable;

insert elements (4) located between the stranded rope elements, wherein said insert elements comprise ribbons or tapes (4), each having two end portions defining a head portion (6) and a base portion (8), respectively, and further having an intermediate portion (7) between said head and base portions, wherein the intermediate portion (7), in cross section, is formed with two opposite concave depressions, said depressions engaging against adjacent rope elements (2);

wherein said insert elements include a fabric reinforcement (16, 86, 96) comprising a woven fabric located adjacent the surfaces of said intermediate portion (7), and integrated with said insert element;

wherein the head portions terminate at a theoretical outer surrounding circle (14) of the rope or cable; and wherein the base portions (8) of the respective insert ribbons or tapes are separate from each other.

10. The rope or cable of claim 9, wherein said reinforcement fabric comprises at least one of a plastic fiber fabric, a glass fiber fabric, a monofilamentary fabric.

11. The rope or cable of claim 9, wherein at least one of said head portion (6), said intermediate portion (7), and said base portion (8) comprises a reinforcement material (86) integrated into the respective portion and formed of at least one of longitudinal fibers, fiber elements, monofilamentary material.

12. The rope or cable of claim 9, wherein the concave depressions (9) define, at least in part, portions of a circle which has a radius of curvature corresponding, at least approximately, to the radius of those stranded wire rope elements in proximity to, or in engagement with, said concave depressions (9).

13. A stranded wire rope or cable having at least six stranded wire rope elements (2) helically stranded about a center line (12) extending longitudinally within the rope or cable; and insert elements (4) located between the stranded rope elements (2);

wherein the insert elements comprise ribbons or tapes (4), each having two end portions defining a head portion (6) and a base portion (8), respectively, and further having an intermediate portion (7) between said head and base portions, wherein the intermediate portion (7), in cross section, is formed with two opposite concave depressions (9) restricting the cross section of the ribbon or tape (4), said depressions engaging against adjacent rope elements (2);

wherein the head portions (6) terminate at a theoretical outer diametrical circle (14) of the rope or cable (1); and wherein the base portions (8) of the respective insert ribbons or tapes are separate from each other;

and wherein said insert elements further comprise a fabric reinforcement (16, 86, 96) located at least in said intermediate portion (7), integrated with said insert elements, and include a woven fabric (96) located essentially in the axis of symmetry of the insert elements (94).

14. The rope or cable of claim 13, wherein said reinforcement fabric comprises at least one of a plastic fiber fabric, a glass fiber fabric, a monofilamentary fabric.

15. The rope or cable of claim 14, wherein at least one of said head portion (6), said intermediate portion (7), and said base portion (8) comprises a reinforcement material (86) integrated into the respective portion and formed of at least one of longitudinal fibers, fiber elements, monofilamentary material.

16. The rope or cable of claim 14, wherein the concave depressions (9) define, at least in part, portions of a circle which has a radius of curvature corresponding, at least approximately, to the radius of those stranded wire rope elements in proximity to, or in engagement with, said concave depressions (9).

17. A method to make insert elements for the combination as claimed in claim 14 comprising the steps of extruding, conjointly, an elastomer plastic material together with the reinforcement fabric (16) to form an integrated, reinforced ribbon or tape with said reinforcement fabric irremovably secured to said elastomer; and, while extruding said elastomer material and said reinforcement fabric, forming said material to a shape which includes for each ribbon or tape the enlarged head portion (6), the wedge-shaped base portion (8) and the intermediate portion (7) between the head and base portions, in which the intermediate portion (7), in cross section, is formed with two concave recesses;

said reinforcement fabric (16) extending at least over said intermediate portion (7);

and, optionally, then carrying out the steps of stranding together a plurality of rope elements (2) and, in one stranding operation and while stranding, positioning said insert ribbons or tapes (4) between adjacent rope elements (2) with said wire rope elements positioned in respective concave recesses, by alternately stranding wire rope elements (2) and insert ribbons or tapes (4).

18. For combination with, a stranded wire, rope or cable having at least four stranded wire rope elements (2) helically stranded about the central line (12) extending longitudinally within the rope or cable, insert elements (4, 64, 94) adapted to be located between the stranded rope elements (2) and comprising ribbons or tapes (4, 64, 94), each having two end portions defining a head portion (6) and a base portion (8), respectively, and further having an intermediate portion (7) between said head and base portions, wherein the intermediate portion (7), in cross section, is formed with two opposite concave depressions (9), said depressions engaging against adjacent rope elements (2);

wherein the head portions (6) terminate at a theoretical outer diametrical circle (14) of the rope or cable (1);

wherein the base portions (8) of the respective insert ribbons or tapes are separate from each other; and further including a reinforcement material (16, 86) comprising at least one of a fabric (16, 96); reinforcement threads or yarn (86) integrated with the material of said insert elements at least in said intermediate portion (7).

19. The insert elements of claim 18, wherein said reinforcement fabric comprises at least one of a plastic fiber fabric, a glass fiber fabric, a monofilamentary fabric.

20. The insert elements of claim 18, wherein at least one of said head portion (6), and said base portion (8) comprises a reinforcement material (86) integrated into the respective portion formed of at least one of longitudinal fibers, fiber elements, monofilamentary material.

21. The insert elements of claim 18, wherein the concave depressions (9) define, at least in part, portions of a circle which has a radius of curvature corresponding, at least approximately, to the radius of those stranded wire rope elements in proximity to, or in engagement with, said concave depressions (9).

* * * * *